United States Patent [19]

Enever

[11] 4,367,103

[45] Jan. 4, 1983

[54] EXPLOSIVE COMPOSITION

[75] Inventor: James A. Enever, Kilmarnock, Scotland

[73] Assignee: Imperial Chemical Industries Limited, London, England

[21] Appl. No.: 123,076

[22] Filed: Feb. 20, 1980

[30] Foreign Application Priority Data

Mar. 7, 1979 [GB] United Kingdom ..... 7908001

[51] Int. Cl.[3] ..... C06B 45/34

[52] U.S. Cl. ..... 149/7; 149/41; 149/42; 149/43; 149/60; 149/109.6

[58] Field of Search ..... 149/7, 41, 42, 43, 60, 149/109.6

[56] References Cited

U.S. PATENT DOCUMENTS

| | | | |
|---|---|---|---|
| 3,005,692 | 10/1961 | Adelman | 149/7 |
| 3,164,503 | 1/1965 | Gehrig et al. | 149/18 |
| 3,507,719 | 4/1970 | Hodgson | 149/7 |
| 3,539,377 | 11/1970 | Steinle | 149/7 |
| 3,834,955 | 9/1974 | Fox | 149/7 |
| 4,104,092 | 8/1978 | Mullay | 149/42 |

FOREIGN PATENT DOCUMENTS

| | | |
|---|---|---|
| 1428865 | 3/1976 | United Kingdom . |
| 2013173 | 8/1979 | United Kingdom . |

*Primary Examiner*—Paul R. Michl

*Attorney, Agent, or Firm*—Cushman, Darby & Cushman

[57] ABSTRACT

A powder explosive composition comprising particulate inorganic oxidizing salt, finely divided metal sensitizer and, optionally additional fuel consisting of discrete granules containing oxidizing salt and sensitizing metal coated with a tough, cohesive, resilient gelled solution of the oxidizing salt, the amount of the coating being insufficient to form a continuous gelled phase. The composition is more water resistant, less dusty and less sensitive to friction and impact than the metal sensitized powder compositions of the prior art.

14 Claims, No Drawings

EXPLOSIVE COMPOSITION

This invention relates to an explosive composition of the kind containing an inorganic oxidising salt and sensitised by a fine metal powder. The composition is in the form of small discrete granules which may be handled and cartridged by means of conventional apparatus used for cartridging explosives. The invention also includes a method of preparing the explosive composition.

Metal sensitised powder explosives devoid of any self-explosive material are well known in the art. They are usually based on an oxidising salt such as ammonium nitrate and finely divided metal such as aluminium. When the metal is in a finely divided flake form such as the commercial paint-grade aluminium, compositions which are sensitive to initiation by a commercial blasting detonator (blasting cap) can be made. Such compositions are described in United Kingdom Patent No. 761,396. These compositions, however, suffer from several disadvantages. Thus they are susceptible to damage by water which can leach out, or cause caking of the oxidising salt. They are also quite sensitive to friction and impact and the aluminium powder gives rise to hazardous airborne dust during mixing and subsequent handling of the composition. Further, the compositions are difficult to cartridge at high density and therefore have low bulk strength.

Metal sensitised explosive compositions in the form of aqueous slurry explosives are also well known in the art, in which compositions particles of oxidising salt and sensitising metal are suspended in a continuous aqueous phase saturated with dissolved salt. Such compositions overcome the disadvantages of water sensitivity, friction and impact sensitivity and dust hazard encountered with powder explosives, but they are more difficult to detonate and usually have low power. Further, for adequate sensitivity they are usually aerated with fine gas bubbles which tend to migrate giving uneven density and sensitivity throughout the mass of the composition.

In general slurry explosives cannot be cartridged in paper cartridges of the kind normally employed for powder explosives because of leakage through the seams of the paper wrapper when the wrapper is closed by the usual creased crimp closure. Specially gelled aqueous slurry explosives gelled to a crumbly friable form designed for cartridging in paper wrappers have been described in United Kingdom Pat. No. 1,428,865. However, like the more conventional slurry explosives their compositions lack the advantageous free-flowing properties of powdered explosive which enable such explosives to be readily poured or blown into cartridges or boreholes.

It is an object of this invention to provide a metal sensitised powdered explosive composition which is more water resistant, less dusty and less sensitive to friction and impact than the metal sensitised powder compositions of the prior art.

We have now discovered that superior explosives based on metal sensitised oxidising salt can be prepared by mixing the salt and metal sensitiser with a solution of the salt in the presence of a gelling agent until the solution is converted to a tough cohesive resilient gel. If the solution is insufficient, when gelled, to form a continuous phase in the mixture, then during the mixing granular agglomerates of the salt and sensitiser are formed and become coated with the gel. The coated granules are generally spherical and remain as discrete granules which have little tendency to stick together.

Thus, in accordance with this invention, a powder explosive composition comprises particulate inorganic oxidising salt, finely divided metal sensitiser and, optionally, additional fuel, in the form of discrete granules containing oxidising salt and metal, said granules being coated with a tough, cohesive, resilient, non-explosive jelly. It will be understood that the amount of jelly will be insufficient to form a continuous gelled phase under the pressure to which the composition will normally be subjected in manufacture and use.

The oxidising salt preferably comprises a nitrate or perchlorate of ammonia, calcium, sodium or potassium and preferred compositions comprise ammonium nitrate optionally in admixture with one or more of the aforementioned salts. The preferred finely divided metal is aluminium, magnesium or iron, preferably in flake form, the preferred metal being paint-grade aluminium. The finely divided metal may be coated with a surface protectant such as stearic acid or may be provided as a paste in a liquid such as a liquid hydrocarbon.

The jelly may comprise non-aqueous liquids, for example, ethylene glycol or dimethyl sulphoxide but water based jelly is generally the most convenient. In the preferred composition the jelly is an aqueous ammonium nitrate solution gelled with a macromolecular gelling agent, for example, starch or natural gum, such as maize starch, guar gum or locust bean gum or derivatives thereof. Soluble salt of carboxymethyl cellulose, and synthetic thickeners such as polyacrylamide are also useful gelling agents. The gelling agent may optionally be crosslinked, for example, with sodium dichromate or zinc chromate.

The composition preferably contains (by weight) from 1 to 10% of the sensitising metal, 50 to 90% of oxidising salt, 7 to 15% of water or other non-explosive liquid and 2 to 5% of gelling agent. Fuels, for example, granular aluminium, gilsonite, pitch, fuel oil, ethylene glycol, dimethylsulphoxide or alkyl mononitrate may also, optionally, be included in the composition.

In accordance with the method of the invention an explosive powder is prepared by mixing particulate inorganic oxidising salt, finely divided metal sensitiser, saturated solution of said inorganic oxidising salt and gelling agent for said solution, so that the sensitiser is uniformly distributed before the gelling agent is fully solvated, the quantity of solution being inadequate when gelled to form a continuous phase in the resulting explosive composition and the amount of gelling agent being sufficient to gel the solution to a tough resilient cohesive gel; and containing mixing at least until the solid constituents agglomerate into granules containing the oxidiser salt and sensitiser and the solution becomes gelled and immobilised as a stable tough resilient coating around the granules. Preferably to ensure complete coating of the granules the amount of saturated solution should be sufficient to suspend the particulate oxidising salt and metal sensitiser in a continuous phase of the solution before the solution becomes gelled.

The mixing process is facilitated when a fast gelling agent is used. Thus, when the liquid is water, a fast hydrating gelling agent such as pre-gelatinised starch or fast-hydrating gum such as locust bean gum is advantageous if short mixing times are desired. However when long term stability of the gel is paramount other slower hydrating gelling agents such as guar gum, or a mixture of fast and slow acting gelling agents, may be preferred.

Advantageously the gelling rate should be such as to permit mixing times (after addition of the gelling agent) within the range 10 to 90 seconds before the liquid becomes gelled.

The size of the coated granules will depend on the particle size of the oxidising salt, the nature of the gelling agent and the rate and type of mixing but conveniently, using readily available materials and low-shear stirring equipment, granules of average size in the range from 0.1 to 2.0 mm may be obtained.

The suspension of oxidising salt in the liquid may include a small amount of thickener for the liquid to act as a suspending agent for the salt. This suspending agent need not be the same material which is subsequently used to gel the liquid. Thus, for example, an aqueous suspension may advantageously contain 0.1 to 0.3% by weight of guar gum or sodium carboxymethyl cellulose (SCMC) whereas the gelling agent may be the same or a different gelling material.

The invention is further illustrated by the following Examples wherein all parts and percentages are indicated by weight. Examples 1 to 7 inclusive are Examples of the invention and Example 8 is included for comparison.

EXAMPLES 1 to 8

Details of the composition and properties of these Examples are given in the accompanying Table. Examples 1 to 7 were prepared in accordance with the invention and Example 8 is an aluminium sensitised ammonium nitrate powder explosive of the prior art.

The ammonium nitrate Grades A and C were specially ground grades having average particle size of 10 microns and 50 microns respectively whereas the Grades B and D were normal explosives grades having average particle size of 100 microns and 250 microns respectively. The sodium nitrate in Example 5 was a normal explosives grade having average particle size of about 150 microns. The paint-grade aluminium was a normal sensitiser grade coated with about 2.5% w/w stearic acid and having a specific surface of about 5 m/g and a water coverage of more than 1.2 $m^2/g$. The atomised aluminium was a normal fuel grade in which all the particles were less than 125 microns.

The pre-gelatinised maize starch was prepared by rolling, heating and drying an aqueous slurry of maize starch. The chromate and dichromate were included as crosslinker for the gelling agents.

In preparing Examples 1 to 7 the ammonium nitrate was mixed as a suspension with the water (containing SCMC as a suspension aid) at 5° C., the water becoming saturated with dissolved ammonium nitrate. The remaining ingredients were added substantially simultaneously to the suspension in a scroll mixer wherein the scroll diameter was 28 cm and the rotational speed was 190 rpm (scroll peripheral speed 167 meters/minute) and mixing was continued for about 20 seconds until the granules containing an agglomerate of ammonium nitrate particles and both grades of aluminium which formed initially became coated with a tough cohesive resilient coating of the gelled solution. The composition was in the form of discrete gel-coated granules which were dimensionally stable, had little tendency to stick together and had adequate water-resistance for use as a blasting agent in damp conditions. The compositions could be handled like powder or semi-gelatine explosive compositions and generated much less dust than the conventional powdered explosive containing paint-grade aluminium during cartridging on conventional cartridging machines or pouring or blow-loading into boreholes for blasting. The average size of the granules was about 0.5 to 1.0 mm. The compositions could be readily packed to densities ranging from 0.90 to 1.35 g/cc.

The composition of Example 8 was prepared by milling the dry ingredients in a conventional dry powder mixer; during cartridging it generated much more dust than the compositions of Examples 1 to 7.

The velocity of detonation and the minimum initiator were determined in 32 mm diameter paper cartridges at 5° C., the packing density being as indicated in the Table. The minimum initiator was determined as the minimum weight of pentaerythritol (PETN) base charge required in a detonator, having a primary charge of 0.1 g lead azide, to initiate detonation in a cartridge.

The power was determined by a ballistic mortar in the standard manner as a percentage of the power of the same weight of Blasting Gelatine. The impact and friction tests were the standard tests using mild steel anvils and weights.

The results show that the less dusty compositions of the invention were much less sensitive to friction and impact then the dusty dry powder of Example 8 and that they had useful explosive properties although they were slightly lower in power due to the water content and the lower aluminium content.

TABLE

| | Example | | | | | | | |
|---|---|---|---|---|---|---|---|---|
| | 1 | 2 | 3 | 4 | 5 | 6 | 7 | 8 |
| Composition % | | | | | | | | |
| Particulate ammonium nitrate - Grade A (10 μm) | 70.8 | — | — | 61.8 | 65.2 | — | — | — |
| - Grade B (100 μm) | — | 70.8 | 70.5 | 9.0 | — | — | — | 82.0 |
| - Grade C (50 μm) | — | — | — | — | — | 36.8 | 36.8 | — |
| - Grade D (250 μm) | — | — | — | — | — | 40.0 | 40.0 | — |
| Sodium nitrate | — | — | — | — | 4.0 | | — | — |
| Water (containing 0.2% SCMC) | 14.0 | 14.0 | 13.8 | 12.7 | 13.3 | 8.2 | 8.2 | — |
| Paint grade aluminium | 5.0 | 5.0 | 2.5 | 5.0 | 4.0 | 5.0 | 5.0 | 7.5 |
| Atomised (fuel-grade) aluminium | 7.0 | 7.0 | 9.5 | 8.0 | 10.0 | 7.0 | 7.0 | 10.5 |
| Pre-gelatinised maize starch | 2.5 | 2.5 | 2.5 | 3.0 | 3.5 | 3.0 | — | — |
| Locust bean gum | — | — | — | — | — | — | 3.0 | — |
| Guar gum | 0.5 | 0.5 | 1.0 | 0.4 | — | — | — | — |
| Sodium dichromate (as 50% aqueous solution) | 0.2 | 0.2 | — | — | — | — | — | — |
| Zinc chromate (as 50% aqueous solution) | — | — | 0.2 | 0.1 | — | — | — | — |
| Properties | | | | | | | | |
| Power (% Blasting Gelatine) | 79.5 | 83.2 | 81.4 | 84.0 | 83.0 | 84.0 | 84.0 | 90.3 |
| Minimum initiator at Δ = 1.10 (weight PETN) | 0.1 g | 0.1 g | 0.8 g | 0.1 g | 0.1 g | 0.1 g | 0.1 g | 0.1 g |
| Velocity of detonation (32 mm diameter) Km/s | | | | | | | | |

TABLE-continued

| | Example | | | | | | | |
|---|---|---|---|---|---|---|---|---|
| | 1 | 2 | 3 | 4 | 5 | 6 | 7 | 8 |
| at Δ = 0.86 | 3.5 | — | — | — | — | — | — | — |
| at Δ = 1.10 | 4.0 | 3.0 | 2.2 | 3.5 | 2.5 | 3.2 | 3.2 | 3.2 |
| Fall hammer impact (1 Kg weight) | >200 cm | >200 cm | >200 cm | >200 cm | >200 cm | >200 cm | >200 cm | 160 cm |
| Torpedo friction (1 Kg weight) | >80 cm | >80 cm | >80 cm | >80 cm | >80 cm | >80 cm | >80 cm | 20 cm |

I claim:

1. A powder blasting or detonating explosive composition comprising particulate inorganic oxidising salt, finely divided metal sensitiser and, optionally, additional fuel, in the form of discrete granules containing oxidising salt and metal, said granules being coated with a tough, cohesive, resilient, non-explosive jelly consisting essentially of inorganic oxidizing salt and gelling agent dissolved in a non-explosive liquid which is retained in the coating.

2. A composition as claimed in claim 1 wherein the finely divided metal is selected from the group consisting of aluminium, magnesium or iron, said metal being in flake form.

3. A composition as claimed in claim 1 wherein the jelly comprises a non-explosive liquid selected from the group consisting of water, ethylene glycol and dimethylsulphoxide.

4. A composition as claimed in claim 3 wherein the jelly comprises aqueous ammonium nitrate solution gelled with a macromolecular gelling agent.

5. A composition as claimed in claim 4 wherein the gelling agent is selected from the group consisting of starch, guar gum, locust bean gum and soluble salts of carboxymethyl cellulose.

6. A composition as claimed in claim 4 wherein the gelling agent is crosslinked.

7. A composition as claimed in claim 1 containing (by weight) from 1 to 10% of sensitising metal, 15 to 90% of oxidising salt, 7 to 15% of water or other non-explosive liquid, 2 to 5% of gelling agent and, optionally, additional fuel.

8. A method for the preparation of a powder explosive composition as claimed in claim 1, which method comprises mixing particulate inorganic oxidising salt, finely divided metal sensitiser, saturated solution of said inorganic oxidising salt and gelling agent for said solution, so that the sensitiser is uniformly distributed before the gelling agent is fully solvated; the quantity of solution being inadequate when gelled to form a continuous phase in the resulting explosive composition and the amount of gelling agent being sufficient to gel the solution to a tough resilient cohesive gel; and continuing mixing at least until the solid constituents agglomerate into granules containing the oxidiser salt and sensitiser and the solution becomes gelled and immobilised as a stable tough resilient coating around the granules.

9. A method as claimed in claim 8 wherein the amount of saturated solution is sufficient to suspend the particulate oxidising salt and metal sensitiser in a continuous phase of the solution before the solution becomes gelled.

10. A method as claimed in claim 8 or claim 9 wherein the gelling agent is a fast gelling agent selected from the group consisting of pre-gelatinised starch and locust bean gum.

11. A method as claimed in any one of claim 8 inclusive wherein the gelling rate of the gelling agent is such as to permit mixing times (after addition of the gelling agent) within the range 10 to 90 seconds before the liquid becomes gelled and immobilised.

12. A method as claimed in claim 8 wherein the suspension of oxidising salt in the liquid includes a suspending agent for the salt.

13. A method as claimed in claim 12 wherein the suspension of oxidising salt is an aqueous suspension and the suspensing agent is selected from the group consisting of guar gum and sodium carboxymethyl cellulose.

14. A blasting or detonating explosive in the form of a pourable or blowable powder of discrete granules each containing inorganic oxidizing salt and metal sensitiser and each being coated with a tough, cohesive, resilient, non-explosive jelly consisting essentially of inorganic oxidizing salt and gelling agent dissolved in a non-explosive liquid.

* * * * *